US010399718B2

(12) United States Patent
Spencer

(10) Patent No.: US 10,399,718 B2
(45) Date of Patent: Sep. 3, 2019

(54) CARDBOARD COIL PROTECTOR SYSTEM

(71) Applicant: PRIMETALS TECHNOLOGIES USA LLC

(72) Inventor: Steven Spencer, Windham, ME (US)

(73) Assignee: Primetals Technologies USA LLC, Alpharetta, GA (US)

( * ) Notice: Subject to any disclaimer, the term of this patent is extended or adjusted under 35 U.S.C. 154(b) by 284 days.

(21) Appl. No.: 15/397,195

(22) Filed: Jan. 3, 2017

(65) Prior Publication Data

US 2018/0186486 A1 Jul. 5, 2018

(51) Int. Cl.

| | |
|---|---|
| ***B65B 13/18*** | (2006.01) |
| ***B65B 27/06*** | (2006.01) |
| ***B21C 47/26*** | (2006.01) |
| ***B65B 13/06*** | (2006.01) |

(52) U.S. Cl.

CPC ..... *B65B 13/181* (2013.01); *B21C 47/26* (2013.01); *B65B 13/06* (2013.01); *B65B 13/185* (2013.01); *B65B 27/06* (2013.01)

(58) Field of Classification Search

CPC ..... B65B 13/181; B65B 13/04; B65B 13/06; B65B 13/20; B65B 13/185; B65B 27/06; B21C 47/26

USPC .... 100/8, 12, 26, 33 PB, 29, 32; 53/13, 157, 53/204, 139.6, 139.7, 580, 582, 589

See application file for complete search history.

(56) References Cited

U.S. PATENT DOCUMENTS 3,271,925 A * 9/1966 Francois ..... B29B 7/566 100/27
3,995,409 A 12/1976 Discavage et al.
4,587,791 A * 5/1986 Brouse ..... B65B 13/181 53/139.6
5,289,668 A * 3/1994 Meyer ..... B65B 13/181 53/139.7

FOREIGN PATENT DOCUMENTS

EP 3103728 12/2016

OTHER PUBLICATIONS

International Search Report and Written Opinion issued in the related PCT Application No. PCT/US2017/067302 dated May 4, 2018.

Partial Search Report issued in the related PCT Application No. PCT/US2017/067302 dated Mar. 7, 2018.

* cited by examiner

*Primary Examiner* — Jimmy T Nguyen

(74) *Attorney, Agent, or Firm* — Gesmer Updegrove LLP

(57) ABSTRACT

A system for isolating each end of a cylindrical coil wall from a tensioned binding medium employed to retain the coil wall in an axially compacted state. The system includes a magazine for containing a supply of pliable inserts. A feeding mechanism advances inserts from the magazine and along a guide for successive delivery to a clamp. The clamp is operative to releasably hold an insert received from the guide. The clamp is shiftable to position the insert in a gap between the end of the coil wall and a path along which a binding medium is directed prior to being tensioned. When the binding medium is tensioned, the insert is pulled from the clamp into a protective position tightly sandwiched between the tensioned binding medium and the coil end.

10 Claims, 10 Drawing Sheets

CARDBOARD COIL PROTECTOR SYSTEM

BACKGROUND OF THE INVENTION

1. Field of the Invention

This invention relates generally to continuous hot rolling mills producing small diameter rods, bars and other like long products. Such products are typically gathered into loose cylindrical coils which are then axially compacted and retained in a compacted stated by straps, wires or other like binding mediums. This invention is concerned in particular with the provision of a system and method for safeguarding the coil ends from damage occasioned by contact with the tensioned binding mediums.

2. Description of the Prior Art

It is known to manually position large annular cardboard rings adjacent to the coil ends prior to the compaction process. The cardboard rings typically are relatively loose fitting, with inner and outer diameters larger than those of the coils. As such, the cardboard rings are prone to being accidently torn off during transport, stacking and handling of the coils.

When binding the coils manually, it is also known to manually apply strips of cardboard beneath the bindings. However, such labor intensive procedures are ill suited to the high production demands of modern mills, where coils are produced at 40 second intervals, or faster.

SUMMARY OF THE INVENTION

In accordance with the present invention, a system is provided for isolating each end of a cylindrical coil wall from a tensioned binding medium employed to retain the coil wall in an axially compacted state.

The system includes a magazine for containing a supply of pliable inserts. A feeding mechanism advances inserts from the magazine and along a guide for successive delivery to a clamp. The clamp is operative to releasably hold an insert received from the guide. The clamp is shiftable to position the insert in a gap between the end of the coil wall and a path along which a binding medium is directed prior to being tensioned. When the binding medium is tensioned, the insert is pulled from the clamp into a protective position tightly sandwiched between the tensioned binding medium and the coil end.

In accordance with another aspect of the present invention, the feeding mechanism may comprise a crank mechanism for reciprocating a shuttle in the guide.

The feeding mechanism may be operable to advance a plurality of inserts in an end-to-end series along the guide, with the first of the inserts in the series being delivered to the clamp.

In accordance with still another aspect of the present invention, a gripper creates a space between the insert releasably held by the clamp and the next successive insert of the series in the guide. The gripper may be configured to engage and impart reverse movement to the next successive insert, with that reverse movement being transmitted to the remainder of the inserts in the guide.

The clamp mechanism may be shiftable radially with respect to the central axis of the cylindrical coil wall to thereby accommodate different coil diameters.

DETAILED DESCRIPTION

Figure 1:
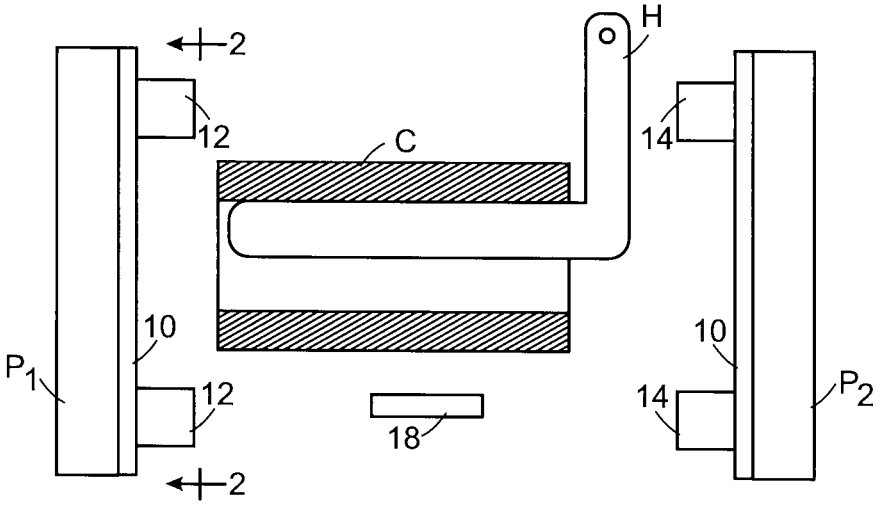
FIG. 1 is a diagrammatic side view of a coil compactor with the platens open to accept a loose coil carried on the hook of an overhead carrier system.

In a typical coil compaction process, as diagrammatically depicted in FIG. 1, a loose coil C of a rod or bar product is carried on the hook H of an overhead carrier system (not shown) to a position between the platens $P_1$, $P_2$ of a conventional coil compactor. The platens may each be provided with press plates 10. Platen $P_1$ carries binding heads 12 designed to apply binding mediums, typically metal straps or wires, to the coils following compaction. Platen $P_2$ carries so called "dummy" binding heads 14 which coact with the binding heads 12 in applying the binding mediums to the compacted coil wall. Binding heads and their companion dummy binding heads are conventional and well known to those skilled in the art.

Figure 2:
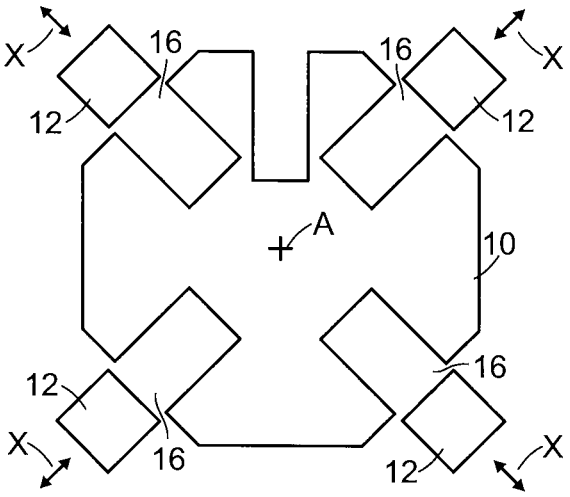
FIG. 2 is a sectional view taken along line 2-2 of FIG. 1.
Figure 4:
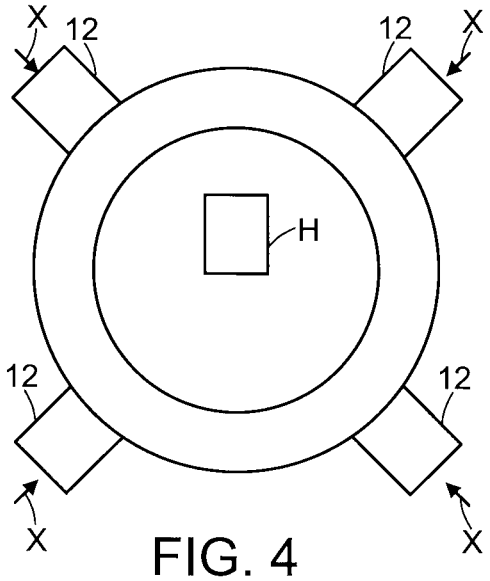
FIG. 4 is a sectional view taken along line 4-4 of FIG. 3.

As shown in FIG. 2, the press plates are configured with notches 16 aligned with the binding heads 12, the latter being adjustable radially as indicated by the arrows "x" with respect to the central axis A of the coil being compacted to thereby accommodate different coil diameters. As shown in FIG. 4, the dummy binding heads 14 are also radially adjustable in directions "x."

Figure 3:
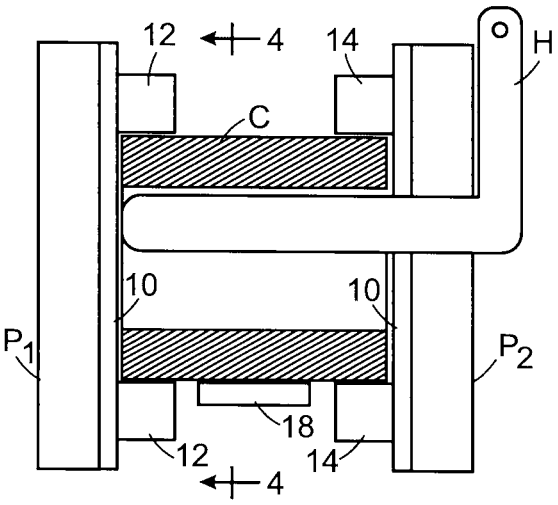
FIG. 3 is a view similar to FIG. 1 showing the platens closed during compaction of the coil.

During a compaction process, as shown in FIGS. 3 and 4, an elevator mechanism 18 raises the coil C off of the hook H, and the platens $P_1$, $P_2$ are advanced towards each other to effect compaction. The binding heads 12 (and the dummy heads 14) are then radially closed to positions contacting the coil.

Figure 5A:
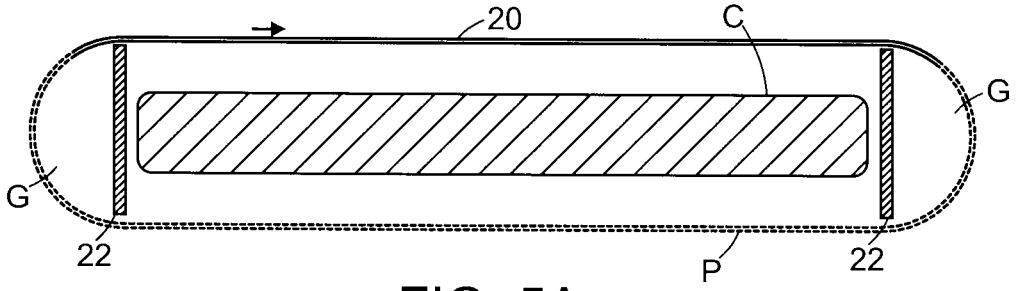
FIGS. 5A and 5B are diagrammatic depictions of the application of a binding medium to a coil wall.

When thus positioned, and as shown in FIG. 5A, the bindings and dummy heads feed a binding medium 20 around the coil wall along a path P, allowing gaps G between the path and the coil ends.

In accordance with the present invention, a system is provided for automatically delivering discrete pliable inserts 22 to each gap G before the binding medium 20 is tensioned.

Figure 5B:
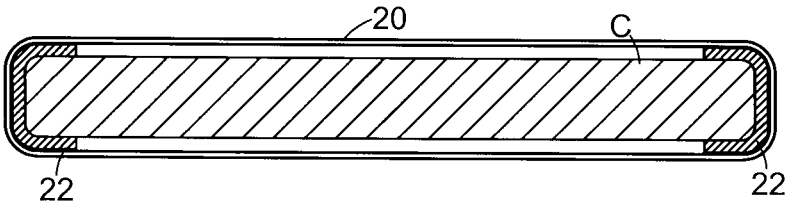

As shown in FIG. 5B, tensioning of the binding medium 20 results in the pliable inserts 22 being tightly sandwiched in protective positions between the binding medium and the coil ends, thus isolating and protecting the coil end from damaging contact with the binding medium.

Figure 6:
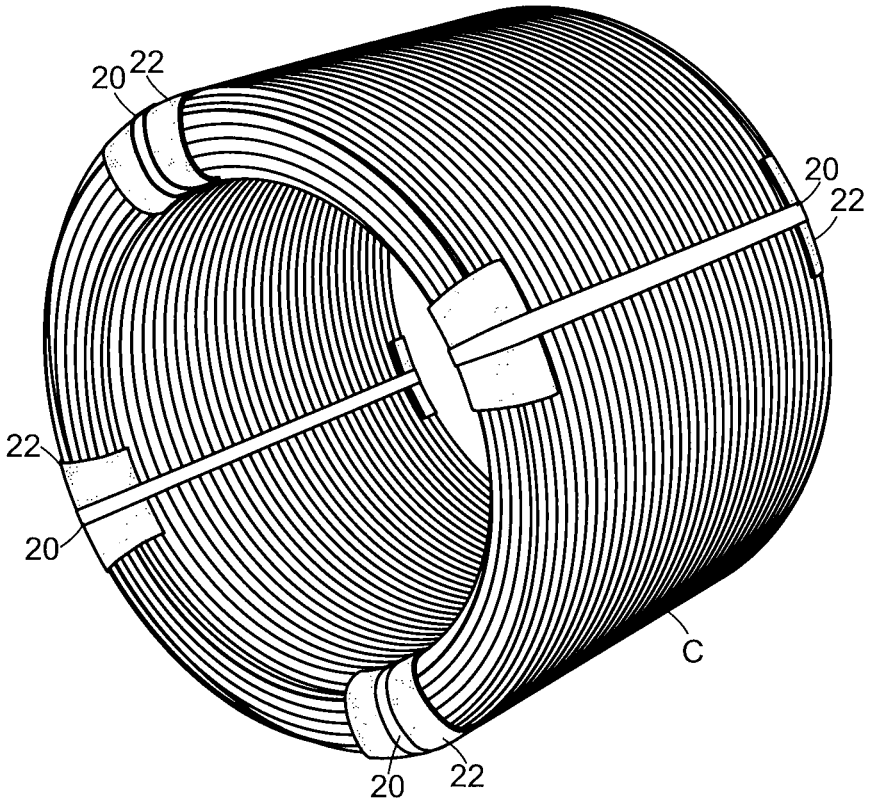
FIG. 6 is a perspective view of a compacted coil with inserts applied in accordance with the present invention in sandwiched protective positions between the bindings and the coil ends.

Thus, as shown in FIG. 6, a compacted coil will be held in a compacted state by multiple bindings 20 with inserts 22 protecting the coil ends from damaging contact with the bindings.

Figure 7A:
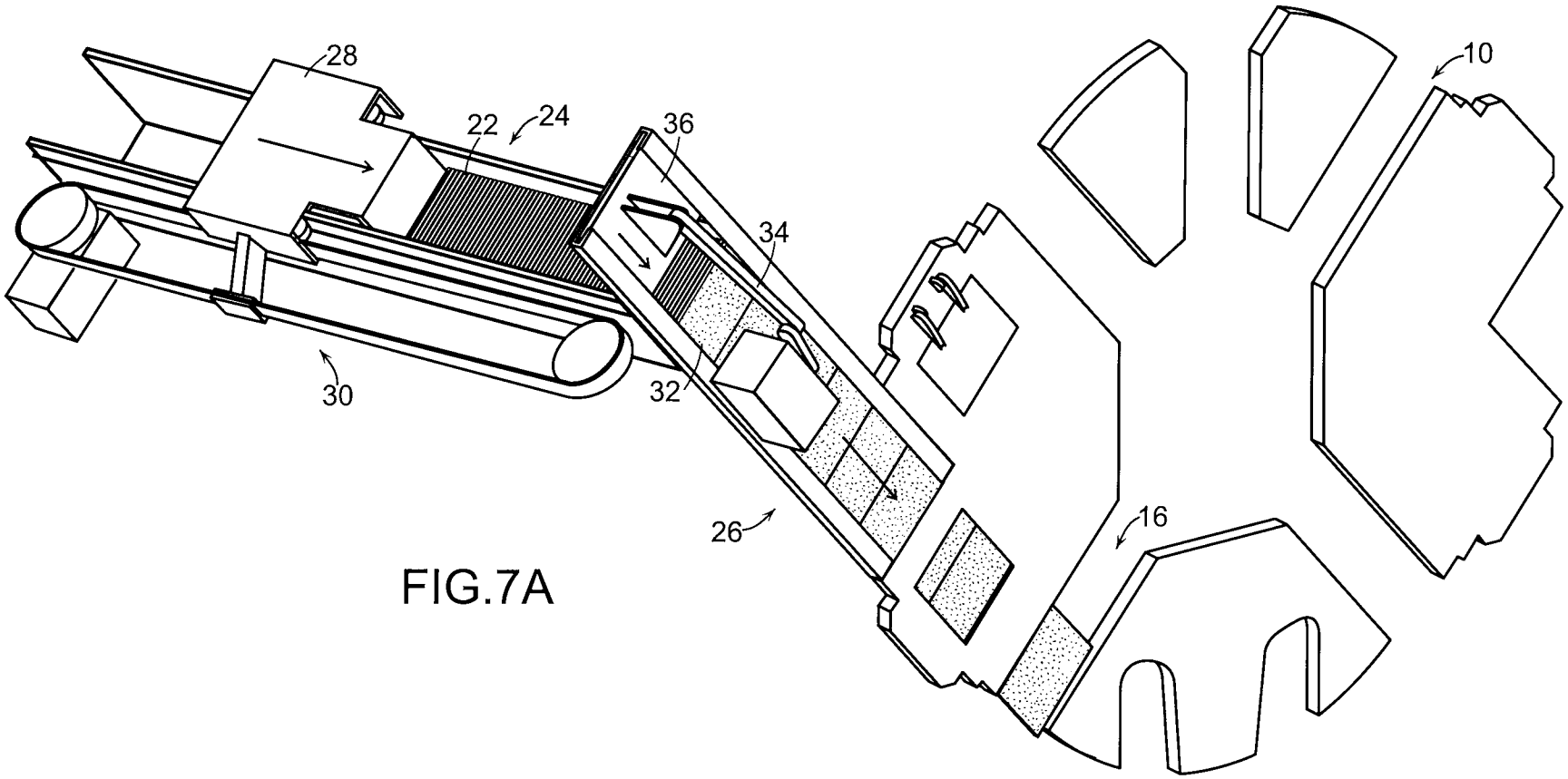
FIGS. 7A and 7B are respectively top and bottom perspective views of an exemplary embodiment of a system in accordance with the present invention.
Figure 7B:
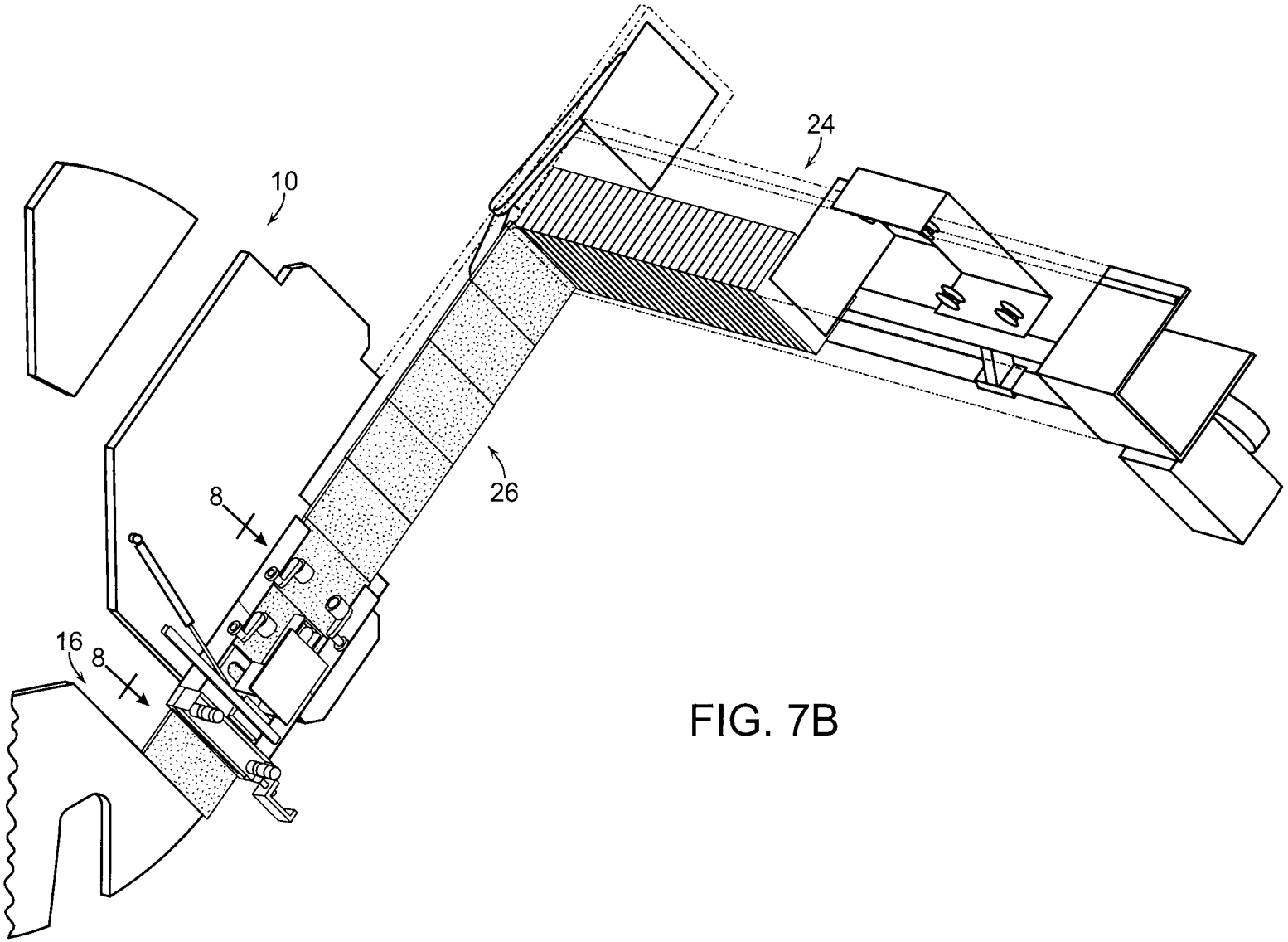

With reference to FIGS. 7A and 7B, an exemplary embodiment of a system in accordance with the present invention for delivering the inserts 22 to a gap G comprises a magazine 24 associated with a guide 26 leading towards one of the notches 16 in a press plate 10. The magazine is configured to contain a stacked supply of the inserts 22. A pusher 28 driven by a motorized belt drive 30 serves to advance the inserts towards a loading chamber 32 in the guide 26.

A feeding mechanism, which may comprise a motor driven crank mechanism 34, drives a reciprocating shuttle 36 which advances inserts received in the loading chamber 32 towards the delivery end of the guide 26 at the press plate notch 16.

Figure 8:
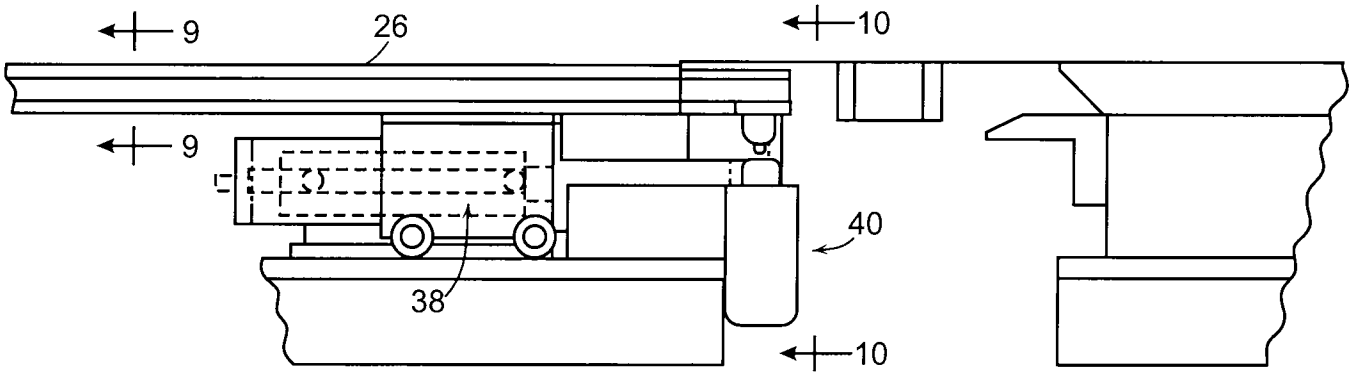
FIG. 8 is a side view of the clamp and gripper taken along line 8-8 of FIG. 7B.
Figure 9:
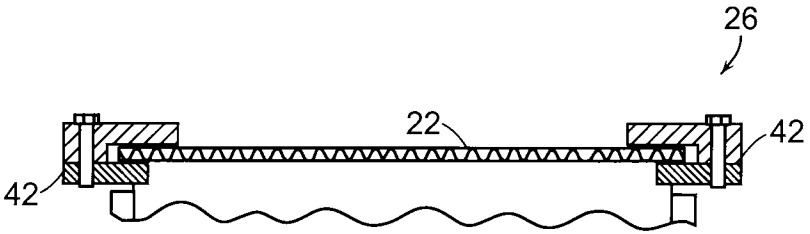
FIG. 9 is a sectional view on an enlarged scale taken along line 9-9 of FIG. 8.

With reference to FIG. 8, a gripper 38 and a clamp 40 are provided at the delivery end of the guide 26. As depicted in FIG. 9, the guide 26 has channel-shaped sides 42 configured and arranged to slidably retain side edges of the inserts 22. The inserts are preferably comprised of inexpensive cardboard, although other comparable pliable materials might also be employed.

Figure 10:
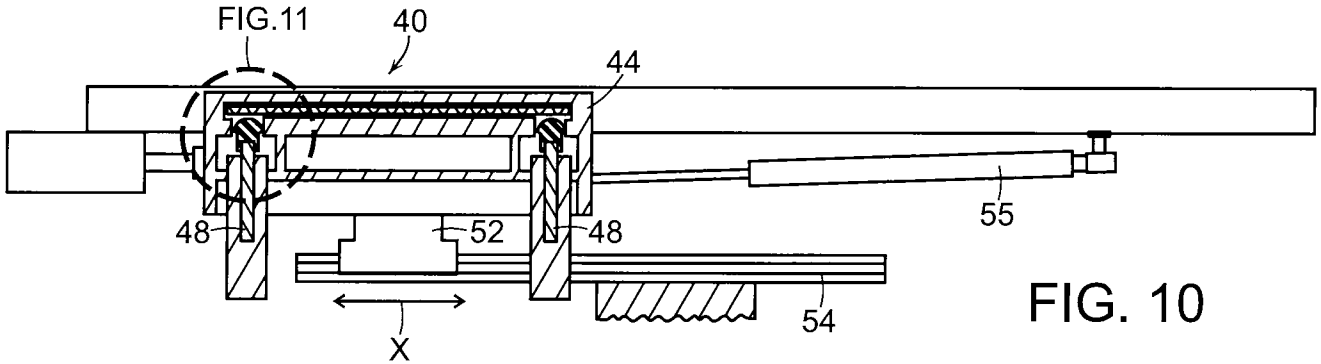
FIG. 10 is an end view of the clamp.
Figure 11:
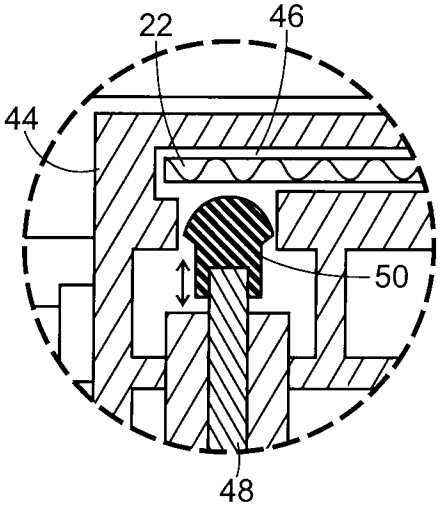
FIG. 11 is an enlarged view of the circled portion in FIG. 10.

As can best be seen in FIGS. 10 and 11, the clamp 40 comprises a clamp body 44 having a slot 46 for receiving the lead insert 22 being advanced along the guide 26. Pneumatically driven pistons 48 with soft rubber or plastic noses 50 serve to releasably grip and hold the side edges of the lead insert 22. The clamp body 44 has a depending foot 52 slidably engaging a guide rail 54, allowing the clamp body to be shifted by and in concert with a respective binding head 12 or dummy head 14 in the direction "x." A gas cylinder 55 or other like device may be employed to ensure return travel of the clamp to its original position aligned with the guide 26. Thus as the binding and dummy heads are closed to their operative positions contacting the coil exterior, the respective clamps 40 will likewise move to position their releasably held inserts 22 in the respective gaps G.

Figure 13:
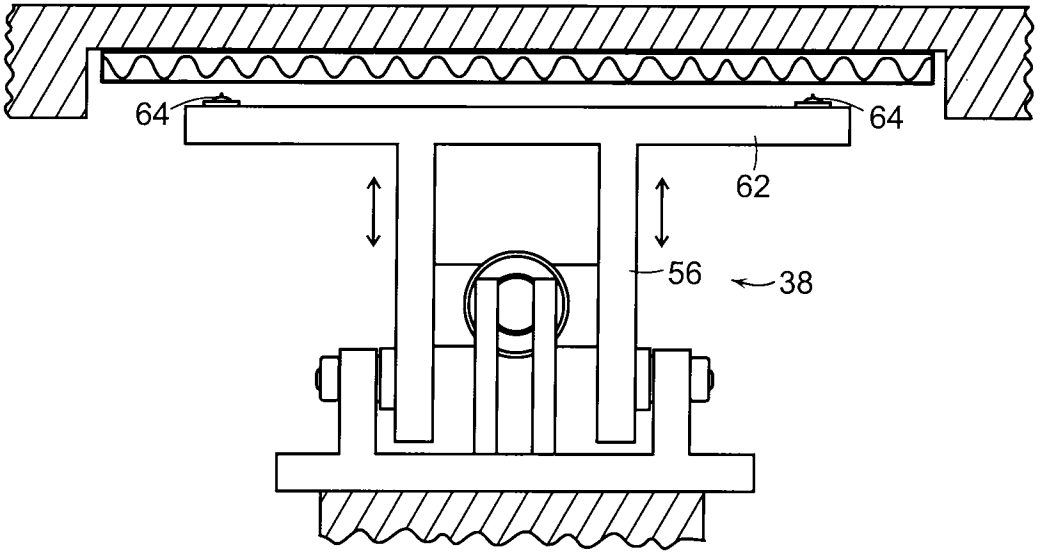
FIG. 13 is an end view of the gripper taken along line 13-13 of FIG. 12.
Figure 12:
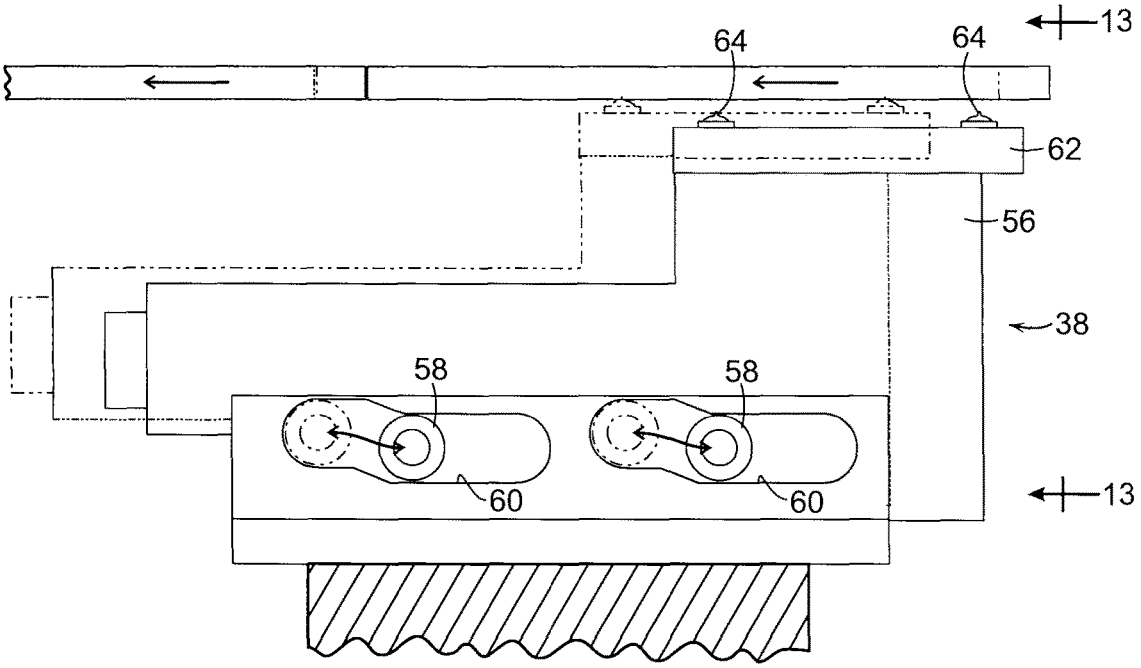
FIG. 12 is an enlarged side view of the gripper.

With reference to FIGS. 12 and 13, the gripper 38 may comprise a gripper head 56 having side rollers 58 projecting into cam tracks 60. A top plate 62 of the gripper head carries pointed projections 64.

In the rest position, as shown by the solid lines in FIG. 12, the pointed projections 64 are spaced beneath the insert 22 that is next in line to the lead insert releasably gripped by the clamp 40. When the gripper head 56 is shifted to the left, again as viewed in FIG. 12, the rollers 58 ride up the inclined edges of the cam tracks 60, causing the pointed projection 64 to pierce and propel the overlying insert in a reverse direction away from the lead insert.

The system of the present invention operates in the following manner to deliver each insert 22 to a respective gap G:

Step 1

Figure 14A:
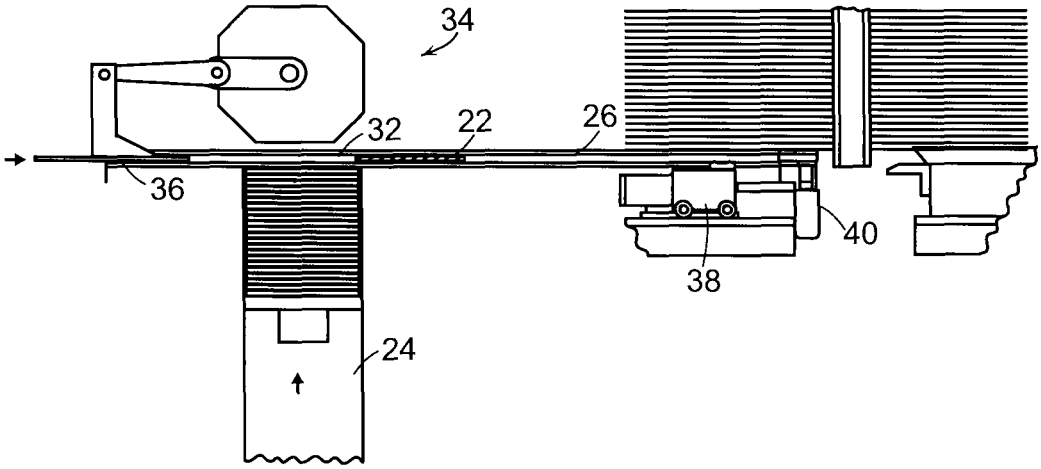
FIGS. 14A-14D are diagrammatic illustrations depicting successive steps in the operation of the system of the present invention.

As shown in FIG. 14A, the first insert 22 has been loaded into the guide 26. The shuttle 36 is fully retracted, allowing the next insert to be fed into the loading chamber 32 from the magazine 24. The clamp 40 is fully retracted, aligning its slot 46 with the guide 26. The gripper 38 is fully retracted (as shown by the solid lines in FIG. 13).

Step 2

Figure 14B:
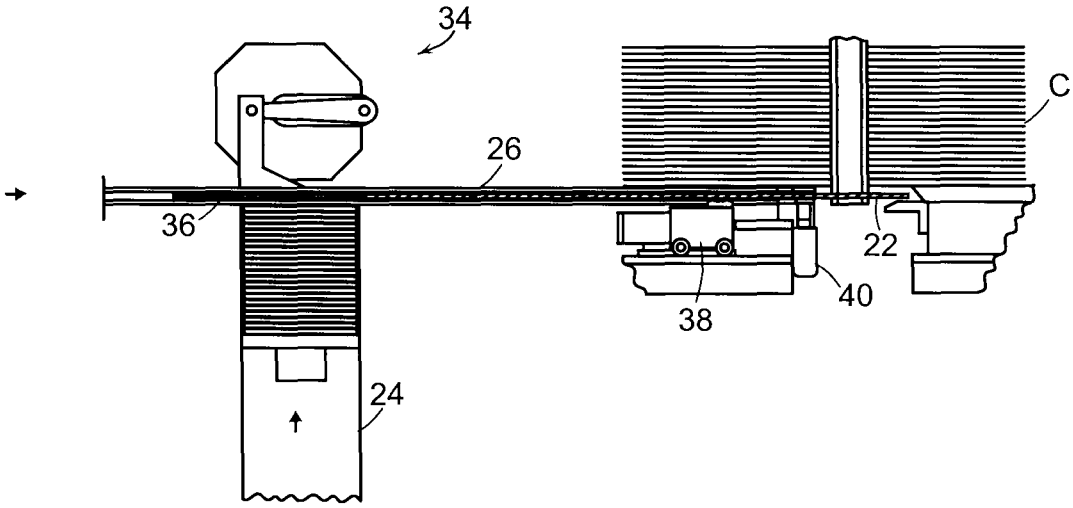

As shown in FIG. 14B, the shuttle 36 has indexed several times to fill the guide 26 with inserts 22. A photo eye (not shown) may be employed to count the inserts to determine when the guide has been filled, with a lead insert delivered to the clamp 40. At this point, the clamp 40 is actuated to releasably hold the lead insert in position.

Step 3

Figure 14C:
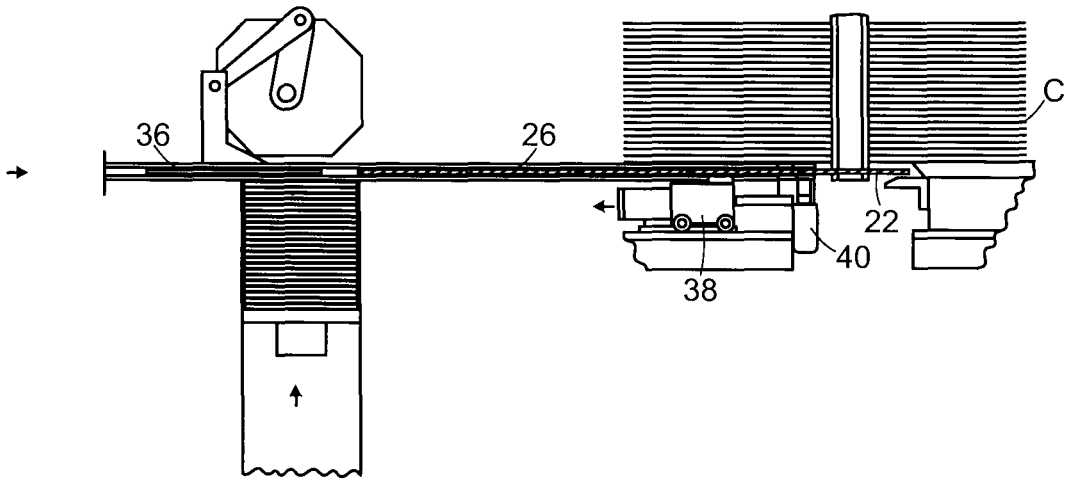

As shown in FIG. 14C the shuttle 36 is parked in a position spaced a small distance from the last insert 22 in the guide 26. This serves to allow space for reverse movement of the inserts in the guide. The gripper 38 then operates (movement to the position shown by the dotted lines in FIG. 12) to push the inserts in the guide back from the lead insert held by the clamp 40.

Step 4

Figure 14D:
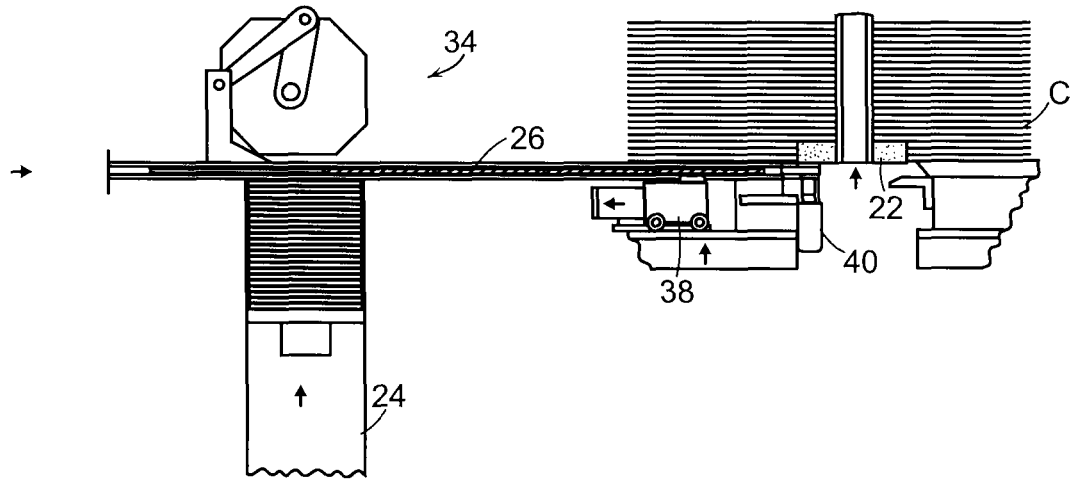

The binding heads 12 and dummy binding heads 14 are closed to their operative positions at the outside diameter of the coil. The clamps 40 shift by and in concert with the respective binding and dummy binding heads to position the lead inserts in the gaps G between the coil ends and the path P of the binding medium (as shown in FIG. 5A). The binding medium is then pulled tight around the coil wall and locked together, pulling the inserts from the clamps 40 (as shown in FIG. 14D) into their protective sandwiched positions (as shown in FIG. 5B).

Step 5

The platens $P_1$, $P_2$ are retracted, and the binding heads 12, dummy binding heads 14 and the clamps 40 are returned to their original positions, the clamps are opened, with their receiving slots aligned, with the guides 26 and the grippers 38 are retracted. The compacted coil C is carried away by on the Hook and the compactor is now ready to receive the next coil.

In light of the foregoing, it will now be appreciated by those skilled in the art that the system of the present invention may be readily integrated into the coil compaction process, with minimal manual intervention, and without adversely impacting the cycle time of the compactor.

What is claimed is:

1. A system for isolating an end of a cylindrical coil wall from a tensioned binding medium employed to retain the coil wall in an axially compacted state, said system comprising:

a magazine containing a supply of pliable inserts;

a feeding mechanism for advancing inserts from said magazine and along a guide for successive delivery to a clamp, said clamp being operative to releasably hold an insert received from said guide, and being shiftable to position said insert in a gap between the end of the coil wall and a path along which the binding medium is directed prior to being tensioned, whereupon tensioning of said binding medium will result in the insert in said gap being pulled from said clamp into a protective position tightly sandwiched between said binding medium and the end of said coil wall; and a gripper for creating a space between a lead insert from said pliable inserts releasably held by said clamp and a next successive insert from said pliable inserts.

2. The system of claim 1 wherein said feeding mechanism comprises a crank mechanism for reciprocating a shuttle in said guide.

3. The system of claim 1 wherein a plurality of said pliable inserts are advanced in an end-to-end series along said guide, with the lead insert in said series being delivered to said clamp.

4. The system of claim 1 wherein said gripper is configured and arranged to engage and impart reverse movement to said next successive insert, with said reverse movement being transmitted to a remainder of the inserts of said series.

5. The system of claim 1 wherein said clamp is moveable radially with respect to a central axis of said cylindrical coil wall to thereby accommodate different coil diameters.

6. A method for isolating an end of a cylindrical coil wall from a tensioned binding medium employed to retain the coil wall in an axially compacted state, said method comprising:

containing a supply of pliable inserts in a magazine;

advancing inserts from said magazine and along a guide for successive delivery to a clamp;

operating said clamp to release by hold inserts received from said guide;

shifting said clamp to position said insert in a gap between the end of said cylindrical coil wall and a path along which said binding medium is directed prior to being tensioned, and creating a space between a lead insert from said pliable inserts releasably held by said clamp and a next successive insert from said pliable inserts whereupon tensioning of said binding medium will result in an insert in said gap being pulled from said clamp into a protective position tightly sandwiched between said tensioned binding medium and the end of said cylindrical coil wall.

7. The method of claim 6 wherein said inserts are advanced along said guide by a reciprocating shuttle.

8. The method of claim 6 wherein a plurality of said pliable inserts are advanced in an end-to-end series along said guide, with the lead insert of said series being delivered to said clamp.

9. The method of claim 6 wherein said space is created by engaging and imparting reverse movement to said next successive insert, with said reverse movement being transmitted to the remainder of the inserts of said series.

10. The method of claim 6 wherein said clamp is shiftable radially with respect to a central axis of said cylindrical coil wall to thereby accommodate different coil diameters.

* * * * *